US006538541B1

(12) United States Patent
Kralik

(10) Patent No.: US 6,538,541 B1
(45) Date of Patent: Mar. 25, 2003

(54) BISTABLE CONTACTOR

(75) Inventor: Robert Kralik, Poing (DE)

(73) Assignee: Schaltbau Aktiengesellschaft, Munich (DE)

( * ) Notice: Subject to any disclaimer, the term of this patent is extended or adjusted under 35 U.S.C. 154(b) by 0 days.

(21) Appl. No.: 09/660,861

(22) Filed: Sep. 13, 2000

(30) Foreign Application Priority Data

Sep. 15, 1999 (DE) ..... 299 16 233 U

(51) Int. Cl.[7] ..... H01H 9/20; H01F 7/00; H01F 7/08

(52) U.S. Cl. ..... 335/177; 335/136; 335/137; 335/179; 335/180; 335/183

(58) Field of Search ..... 335/177–183, 335/229–234, 255, 256, 266, 106, 127, 131, 136, 137

(56) References Cited

U.S. PATENT DOCUMENTS 5,652,558 A 7/1997 Leikus et al.
6,262,648 B1 * 7/2001 Lammers ..... 335/229

FOREIGN PATENT DOCUMENTS

DE 1464867 A 5/1969
DE 1800088 A 11/1970
DE 3135360 A1 3/1983
DE 19509195 A1 9/1996
DE 19744396 A1 4/1999
EP 3783887 T2 5/1993
FR 1164565 A 10/1958

OTHER PUBLICATIONS

Boll, "Weichmagnetische Werkstoffe," Vacuumschmelze GMBH, Hanau, Deutschland XP002209110, Seite 57, Spalte 1, Zeile 3 –Zeile 9; Abbildung 3.3, No Date.

* cited by examiner

*Primary Examiner*—Ramon M. Barrera
(74) *Attorney, Agent, or Firm*—Townsend and Townsend and Crew LLP

(57) ABSTRACT

A bistable contactor comprises at least two concentrically arranged coils, an armature that is movable relative to the coils, a permanent magnet that is stationary relative to the coils, and a spring element. The armature includes contacts for opening and closing a circuit. The coils move the armature and contacts between a first stable position and a second stable position. In the first stable position, the armature is held in position by the permanent magnet, and in the second stable position, the armature is biased into position by the spring element.

7 Claims, 1 Drawing Sheet

BISTABLE CONTACTOR

BACKGROUND OF THE INVENTION

The present invention relates to a bistable contactor comprising at least one coil and an armature which is movable relative to the coil and includes contacts and which together with the contacts for opening or closing a circuit can be moved by means of the coil from a first stable position into a second stable position, and a permanent magnet through which the armature is supported in one of its stable positions relative to the coil.

Such a contactor is e.g. known from DE 197 44 396. In this contactor the contacts are resiliently supported on the armature. For opening and closing a circuit the armature is moved by excitation of the coil from a first stable position in which the contacts are spaced apart from corresponding counter-contacts of the relay, into a second stable position in which the contacts rest on the counter-contacts for closing the circuit. The permanent magnet is secured to the armature and is thus movable relative to the coil. The coil is briefly excited for moving the armature between its two stable positions. In the non-excited state, a magnetic circuit is respectively closed by the permanent magnet in the two stable positions so that the armature is respectively held in one of the two stable positions. However, the inertia of the armature is increased due to the permanent magnet. Contact problems may in particular arise in the case of vibration-induced loads. The switching speed is also limited thereby.

BRIEF SUMMARY OF THE INVENTION

It is therefore an object of the invention to further develop bistable contactors of the above-mentioned kind in such a manner that higher switching speeds can be achieved and a reliable contact is ensured in the closed state of the circuit at the same time.

Said object is achieved according to the invention by the features that the permanent magnet is stationary relative to the coil and that there is provided a spring element which biases the armature into the other bistable position to be spaced apart from the permanent magnet.

Such a solution is simple and offers the advantage that the permanent magnet need no longer be mounted on the armature. Instead of this, the permanent magnet can e.g. be mounted on a housing to be stationary relative to the coil. The armature can thus be configured with a reduced weight. Thanks to such a lightweight armature the contact reliability can in particular be enhanced in the case of vibration-induced loads. This also permits a simple structure of the contactor. Fewer demands are made on the guide characteristics of the armature.

In a further advantageous development of the invention, the armature may rest on the permanent magnet, preferably the pole shoe thereof, in the one of the two bistable positions. A particularly stable position of the armature can be realized thereby because in contrast to conventional bistable contactors there is no air gap between armature and permanent magnet in the respective stable position.

Moreover, it may turn out to be of advantage when the circuit is closed in the stable position produced by the permanent magnet. An inadvertent opening of the circuit can thereby be avoided with the permanent magnet.

In an advantageous development of the invention there may be provided two coils, with the armature being movable into one of its two stable positions by excitation of a respective coil. As a result, the polarity of the coil need not be reversed for moving the armature between the two stable positions. Instead of this, a respective coil can be used for movement into one of the two positions. The circuit expenditure can thus be reduced.

It may be of advantage when the coils are designed as cylindrical coils which are concentrically arranged relative to one another. The two coils can thereby be arranged in a compact manner.

Moreover, it may turn out to be of advantage when the permanent magnet is arranged inside the one coil or the coils. The contactor can also be made more compact in this way. Moreover, a strong magnetic flux can be produced by the permanent magnets arranged within the coil or one of the coils.

It might also turn out to be of advantage when the spring element is designed as a compression spring. Thanks to such a compression spring the armature can be biased in a reliable and easy manner into one of its two stable positions.

DESCRIPTION OF THE PREFERRED EMBODIMENTS

Figure 1:
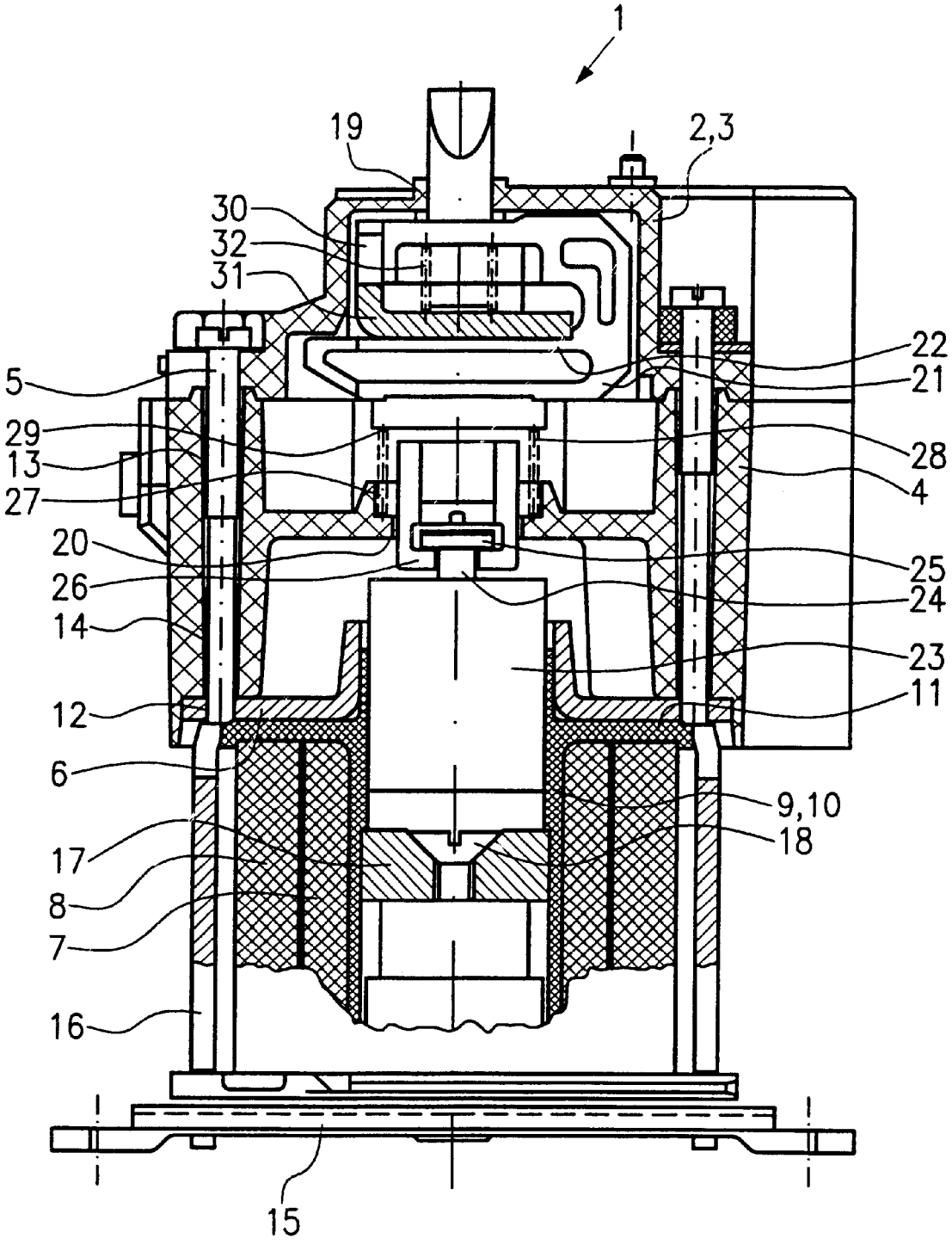
FIG. 1 is a sectional view showing a bistable contactor in accordance with an embodiment of the present invention.

The invention shall now be explained in more detail with reference to an embodiment.

FIG. 1 is a sectional view showing a bistable contactor according to an embodiment of the invention.

Contactor 1 comprises a substantially cylindrical housing 2 consisting of an upper housing part 3 and a lower housing part 4. The upper housing part 3 and the lower housing part 4 are mounted in flange-like fashion one upon the other and are interconnected by screws 5. A coil holder 6 which has mounted thereon two coils 7 and 8 that are concentric relative to each other is provided at the lower end of the lower housing part 4. The two coils 7 and 8 are made substantially cylindrical, their axis of symmetry lying within the axis of symmetry of housing 2. A guide element 9 of plastics extends between coil holder 6 and coils 7 and 8.

The guide element 9 has a cylindrical, substantially tubular guide section 10 and a flange section 11 radially extending thereto. The guide section 10 extends through the inner one of the two coils in axial direction. The flange section is positioned between coil holder 6 and coils 7 and 8 to extend in a substantially radial direction.

The coil holder 6 is provided with threads 12 into which screws 5 are screwed. Screws 5 extend through passage openings 13 and 14 in the upper housing part 3 and the lower housing part 4, respectively, so that the screws 5 connect the upper housing part 3 and the lower housing part 4 to each other and to the coil holder 6.

A flange 15 which is connected via holding elements 16 to the coil holder 6 is provided on the coil holder 6 at the side facing away from the housing 2. Within the inner coil 7 and within the guide section 10 of the guide element 9 there is provided a permanent magnet including a pole shoe 17 which is connected via a screw 18 and a thread (not shown) to the flange 15. The permanent magnet 17 is substantially centrally arranged in the axial direction of the coils.

In housing 2 there are provided two passage openings 19 and 20 in which a contact element 21 with contacts 22 is received in an axially displaceable manner. The guide section 10 of guide element 9 has arranged therein, also in an axially displaceable manner, an armature 23 which is connected via a pin 24 mounted on the armature 23 and via a support element 25 to a holder 26 of the contact element 21. The holder 26 grips around the support element 25, whose diameter is greater than the diameter of the pin for interconnecting the armature 23 and the contact element 21 in axial direction.

The armature 23 is made in a known way from magnetizable material, such as metal. The contact element 21 may also be made from metal. The passage opening 20 is arranged in the lower housing part 4 on an intermediate bottom which is provided with a receiving means 27. The receiving means 27 is concentric to the axis of symmetry of the armature and serves to receive a compression spring 28 which is supported between the receiving means 27 and a contact surface 29 of the contact element 21. In the illustration of the figure the contact element is thereby biased into the lifted position.

Furthermore, a counter-contact element 30 is provided inside the housing 2 on the upper housing part 3. The counter-contact element 30 has counter-contacts 31 which can be brought into contact with contacts 22. As illustrated in the figure, the counter-contact element 30 is biased by a compression spring 32 downwards, i.e. towards the contact element. To this end the counter-contact element is slightly movable in the axial direction of the armature.

The mode of operation of the bistable contactor 1 shall now be explained in more detail.

The contactor may be mounted via flange 15, for instance, on an electric machine. The mounting operation is carried out in the known manner and thus need not be explained any further. In the illustration of the figure, the assembly consisting of armature 23, contact element 21 and contact 22 can be moved back and forth in a vertical direction between two stable positions. In the first, lowered stable position the armature 23 gets into contact with the pole shoe of the permanent magnet 17. The armature 23 is held against the compressive force of the compression spring 28. In the second stable position, which is lifted in the figure, the armature 23 is spaced apart from the permanent magnet 17. The contact element 21 with the armature 23 is here biased by the compression spring 28 into the lifted position. Said stable position is shown in the figure. In said position contacts 22 and counter-contacts 31 get disengaged, so that a circuit (not shown) can be opened. In the first lowered position the contacts 22 and counter-contacts 31 are in engagement so that the circuit is closed. Alternatively, the contactor could also be designed such that the circuit is broken in the lowered position and closed in the lifted position.

The armature 23 is moved from the first into the second position and vice versa by the two coils 7 and 8. Coil 7 is briefly excited for moving the armature from the first into the second position and coil 8 for moving the armature from the second into the first position. When the two coils 7 and 8 are currentless, the armature is in the first or second stable position, depending on which one of the two coils 7 and 8 has been operated before.

In the first lowered position the armature 23 rests on the pole shoe of the permanent magnet. A strong attractive force is exerted on the armature 23 by such a contact so that the armature 23 is reliably held in the first stable position.

When the permanent magnet 17 has been moved into the second position, the permanent magnet and the armature 23 are spaced apart from each other to a sufficient extent to exert no or only a small attractive force on one another. The armature 23 with the contact element 21 is then held by the compression spring 28 in the second stable position. Armature 23 is thus located in one of its two stable positions without requiring the activation of coils 7 and 8. The contactor can thus be operated in an energy-saving manner.

Since the permanent magnet is not mounted on the armature, it can be made very lightweight. The switching rate can thus be increased. In addition, the reduced weight of the armature effects a reliable contact between contacts 21 and counter-contacts 31, for instance during vibratory operation. The structure of the contactor is simplified thanks to the smaller demands made on the guide characteristics of the armature.

What is claimed is:

1. A bistable contactor comprising:

first and second coils concentrically arranged relative to one another;

an armature movable relative to the coils and provided with contacts for opening or closing a circuit, the armature and the contacts being moveable together by means of the coils between a first stable position and a second stable position;

a permanent magnet, stationary relative to the coils, holding the armature in the first stable position; and a spring element for biasing the armature into the second stable position, the armature being spaced apart from the permanent magnet when in the second stable position.

2. The bistable contactor according to claim 1, wherein in one of the first and second stable positions the armature rests on the permanent magnet.

3. The bistable contactor according to claim 1, wherein the circuit is closed when the armature is in the first stable position.

4. The bistable contactor according to claim 1, wherein two coils are provided and the armature is movable into one of the first and second stable positions by excitation of a respective one of the two coils.

5. The bistable contactor according to claim 1, wherein the permanent magnet is arranged within the two coils.

6. The bistable contactor according to claim 1, wherein the spring element is designed as a compression spring.

7. A bistable contactor according to claim 2, wherein in the permanent magnet includes a pole shoe and the armature rests on the pole shoe in one of the first and second stable positions.

* * * * *